US006466130B2

(12) United States Patent
Van Horn et al.

(10) Patent No.: US 6,466,130 B2
(45) **Date of Patent: *Oct. 15, 2002**

(54) WIRELESS COMMUNICATION DEVICES, WIRELESS COMMUNICATION SYSTEMS, COMMUNICATION METHODS, METHODS OF FORMING RADIO FREQUENCY IDENTIFICATION DEVICES, METHODS OF TESTING WIRELESS COMMUNICATION OPERATIONS, RADIO FREQUENCY IDENTIFICATION DEVICES, AND METHODS OF FORMING RADIO FREQUENCY IDENTIFICATION DEVICES

(75) Inventors: Mark T. Van Horn, Boise; David K. Ovard; Scott T. Trosper, both of Meridian, all of ID (US)

(73) Assignee: Micron Technology, Inc., Boise, ID (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/363,944

(22) Filed: Jul. 29, 1999

(65) Prior Publication Data

US 2001/0054959 A1 Dec. 27, 2001

(51) Int. Cl.[7] ..... G08B 13/14

(52) U.S. Cl. ..... 340/572.1; 340/10.1; 340/571; 340/572.8

(58) Field of Search ..... 340/572.1, 571, 340/825.34, 10.1, 10.6, 5.8, 572.8; 342/51

(56) References Cited

U.S. PATENT DOCUMENTS 4,075,632 A 2/1978 Baldwin et al. ..... 342/51
4,223,830 A 9/1980 Walton
4,236,068 A 11/1980 Walton
4,476,469 A 10/1984 Lander
4,675,656 A 6/1987 Narcisse
4,926,182 A 5/1990 Ohta et al. ..... 342/44

(List continued on next page.)

OTHER PUBLICATIONS http://www.aimglobal.org/technologies/rfid/; Aim, Inc.; "RFID", Mar. 9, 2001; pp. 1–2.

SN: 08/907,689, Wood, Jr, Original Application; filed Aug. 8, 1997.

SN: 09/363,945, Scott T. Trosper, Original Application; filed Jul. 29, 1999.

SN: 09/364,249, Scott T. Trosper, Original Application; filed Jul. 29, 2001.

*Primary Examiner*—Thomas Mullen
(74) *Attorney, Agent, or Firm*—Wells, St. John, P.S.

(57) ABSTRACT

This invention provides radio frequency identification devices, wireless communication systems, communication methods, methods of forming a radio frequency identification device, methods of testing wireless communication operations, and methods of determining a communication range. According to a first aspect, a radio frequency identification device includes a substrate; communication circuitry coupled with the substrate and configured to at least one of receive wireless signals and communicate wireless signals; and indication circuitry coupled with the communication circuitry and configured to indicate operation of the radio frequency identification device. A communication method according to another aspect includes providing a radio frequency identification device including indication circuitry; receiving a wireless signal within the radio frequency identification device; and indicating operation of the radio frequency identification device using the indication circuitry after the receiving.

88 Claims, 6 Drawing Sheets

U.S. PATENT DOCUMENTS 5,087,906 A 2/1992 Eaton et al.
5,113,183 A 5/1992 Mizuno et al.
5,119,069 A 6/1992 Hershkevitz et al.
5,151,684 A 9/1992 Johnsen
5,214,410 A * 5/1993 Verster ..... 340/572.1
5,337,041 A 8/1994 Friedman
5,416,486 A 5/1995 Koert et al.
5,450,070 A 9/1995 Massar et al.
5,539,393 A * 7/1996 Barfod ..... 340/825.52
5,550,547 A 8/1996 Chan et al.
5,565,858 A 10/1996 Guthrie
5,570,080 A * 10/1996 Inoue et al. ..... 340/571
5,581,257 A 12/1996 Greene et al.
5,617,060 A 4/1997 Wilson et al. ..... 330/129
5,621,412 A 4/1997 Sharpe et al. ..... 340/10.33
5,649,295 A 7/1997 Shober et al.
5,649,296 A 7/1997 MacLellan et al. ..... 455/38.2
5,652,569 A 7/1997 Gerstenberger et al.
5,656,998 A * 8/1997 Fujiuchi et al. ..... 340/571
5,686,902 A 11/1997 Reis et al.
5,689,240 A 11/1997 Traxler
5,742,238 A * 4/1998 Fox ..... 340/825.49
5,771,002 A 6/1998 Creek et al.
5,777,561 A 7/1998 Chieu et al.
5,787,174 A 7/1998 Tuttle
5,796,351 A * 8/1998 Yabuki ..... 340/10.33 X
5,841,770 A 11/1998 Snodgrass et al.
5,850,181 A 12/1998 Heinrich et al.
5,861,817 A * 1/1999 Palmer et al. ..... 340/825.49 X
5,874,902 A 2/1999 Heinrich et al.
5,905,429 A * 5/1999 Hornstein et al. ... 340/568.1 X
5,929,778 A 7/1999 Asama et al.
5,939,981 A 8/1999 Renney
5,940,006 A 8/1999 MacLellan et al.
5,949,328 A 9/1999 Latty
5,952,922 A 9/1999 Shober
5,963,133 A * 10/1999 Monjo ..... 340/572.1
5,963,177 A 10/1999 Tuttle et al.
5,966,082 A 10/1999 Cofino et al.
5,988,510 A 11/1999 Tuttle et al.
5,995,019 A 11/1999 Chieu et al.
6,008,727 A * 12/1999 Want et al. ..... 340/572.4 X
6,023,610 A 2/2000 Wood, Jr.
6,024,285 A 2/2000 Mish
6,027,027 A 2/2000 Smithgall
6,031,459 A 2/2000 Lake
6,052,062 A 4/2000 Tuttle
6,078,260 A 6/2000 Desch
6,084,512 A 7/2000 Elberty et al. ..... 340/572.1
6,130,602 A 10/2000 O'Toole et al.
6,130,623 A * 10/2000 MacLellan et al. ..... 340/10.1
6,133,830 A 10/2000 D'Angelo et al.
6,137,422 A 10/2000 Hahn et al.
6,147,602 A 11/2000 Bender
6,184,789 B1 2/2001 Richley et al.
6,198,392 B1 3/2001 Hahn et al. ..... 340/572.4
6,275,142 B1 8/2001 Paleiov et al. ..... 340/10.1
6,289,209 B1 9/2001 Wood Jr.
6,304,183 B1 10/2001 Causey ..... 340/572.1
6,326,889 B1 12/2001 Van Horn et al.
6,333,690 B1 12/2001 Nelson et al.

* cited by examiner

WIRELESS COMMUNICATION DEVICES, WIRELESS COMMUNICATION SYSTEMS, COMMUNICATION METHODS, METHODS OF FORMING RADIO FREQUENCY IDENTIFICATION DEVICES, METHODS OF TESTING WIRELESS COMMUNICATION OPERATIONS, RADIO FREQUENCY IDENTIFICATION DEVICES, AND METHODS OF FORMING RADIO FREQUENCY IDENTIFICATION DEVICES

TECHNICAL FIELD

This invention relates to radio frequency identification devices, wireless communication systems, communication methods, methods of forming a radio frequency identification device, methods of testing wireless communication operations, and methods of determining a communication range.

BACKGROUND OF THE INVENTION

Wireless communication systems including electronic identification devices, such as radio frequency identification devices (RFIDs), are known in the art. Such devices are typically used for inventory tracking. As large numbers of objects are moved in inventory, product manufacturing, and merchandising operations, there is a continuous challenge to accurately monitor the location and flow of objects. Additionally, there is a continuing goal to determine the location of objects in an inexpensive and streamlined manner. One way of tracking objects is with an electronic identification system.

One presently available electronic identification system utilizes a magnetic coupling system. Typically, the devices are entirely passive (have no power supply), which results in a small and portable package. However, such identification systems are only capable of operation over a relatively short range, limited by the size of a magnetic field used to supply power to the devices and to communicate with the devices.

Another type of wireless communication system is an active wireless electronic identification system. Attention is directed towards commonly assigned U.S. patent application Ser. No. 08/705,043, filed Aug. 29, 1996, now U.S. Pat. No. 6,130,602, incorporated herein by reference, and which describes such active systems in detail.

These systems include integrated circuit devices which include an active transponder and are intended to be affixed to an object to be monitored. The devices are capable of receiving and processing instructions transmitted by an interrogator. A device receives the instruction, if within range, then processes the instruction and transmits a response, if appropriate. The interrogation signal and the responsive signal are typically radio-frequency (RF) signals produced by an RF transmitter circuit. Because active devices have their own power sources, such do not need to be in close proximity to an interrogator or reader to receive power via magnetic coupling. Therefore, active transponder devices tend to be more suitable for applications requiring tracking of a tagged device that may not be in close proximity to an interrogator. For example, active transponder devices tend to be more suitable for inventory control or tracking.

It is often desired to determine or otherwise obtain the range of communications of a wireless communication system. For example, electronic identification systems may be installed in different environments, such as a variety of warehouse configurations, manufacturing plants, retail premises, etc. The communication range of an electronic identification system, or other wireless communication system, can be greatly impacted by the environment in which the system is utilized. Thus, it is often desired to determine the communication range of the system following implementation of the same in a particular environment and application.

SUMMARY OF THE INVENTION

This invention includes radio frequency identification devices, wireless communication systems, communication methods, methods of forming a radio frequency identification device, methods of testing wireless communication operations, and methods of determining a communication range.

According to one aspect of the present invention, a remote communication device includes a radio frequency identification device having a substrate and communication circuitry coupled with the substrate and configured to at least one of receive wireless signals and communicate wireless signals. Exemplary communication circuitry includes transponder circuitry operable to output return link identification signals responsive to receiving forward link wireless signals. Such forward link wireless signals can be outputted using an interrogator and the return link wireless signals can be outputted using the remote communication device.

The remote communication device preferably includes indication circuitry coupled with the communication circuitry and configured to indicate operations of the remote communication device and/or an associated interrogator. For example, the remote communication device can indicate at least one of receiving and generating of signals. The indication circuitry emits a human perceptible signal, such as a visible signal, in but one configuration to indicate operation of the remote communication device. The remote communication device of the present invention can be utilized in an exemplary application to assist with the determination of a communication range of the wireless communication system. Also, the remote communication device can be utilized to verify correct installation and operation of a wireless communication system, including antenna functionality, for example. Other aspects are provided in the present invention.

BRIEF DESCRIPTION OF THE DRAWINGS

Preferred embodiments of the invention are described below with reference to the following accompanying drawings.

FIG. 6 is a graphical illustration representing exemplary remote communication device operations.

FIG. 7 is a graphical illustration showing further details of the illustration of FIG. 6.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
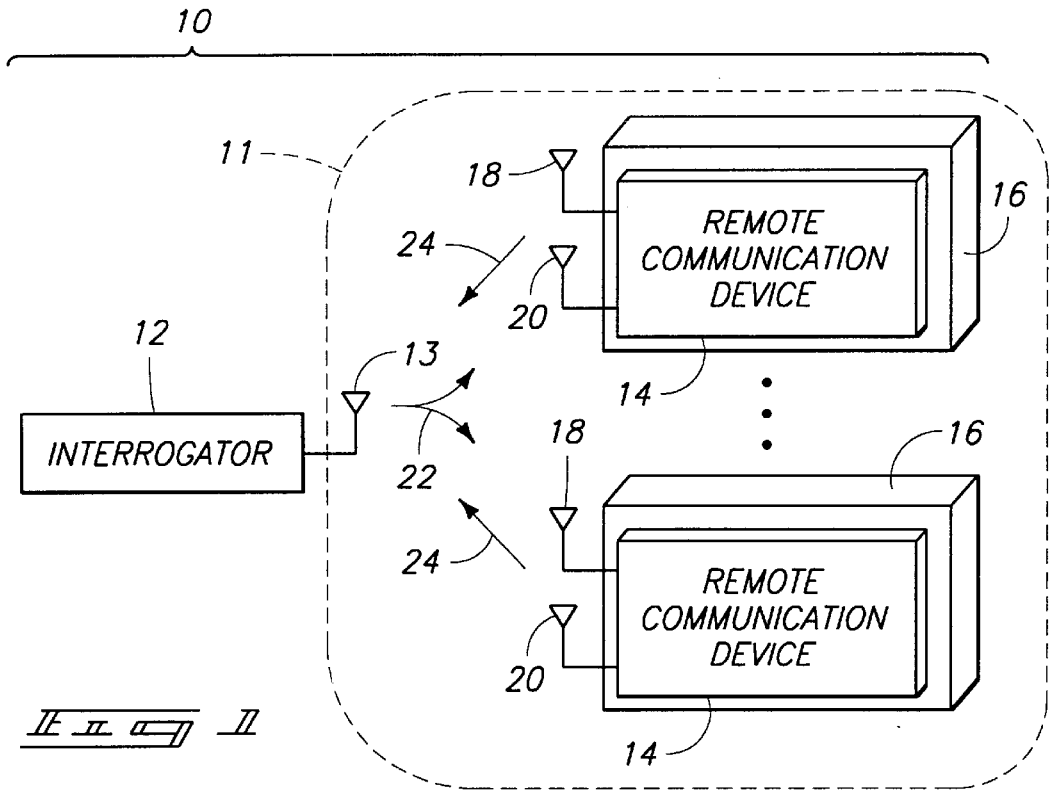
FIG. 1 is an illustrative diagram of an exemplary wireless communication system.

Referring to FIG. 1, a wireless communication system 10 is illustrated in accordance with one embodiment of the invention. Wireless communication system 10 includes an interrogator 12 and at least one remote communication device 14. Typically, numerous remote communication devices 14 are provided within wireless communication system 10 although only two such remote communication devices 14 are illustrated in FIG. 1. The particular number of remote communication devices 14 which are in communication with interrogator 12 may change over time. During exemplary object monitoring operations, more or less remote communication devices 14 can be within a communication range of wireless communication system 10 as objects or packages are moved about. Alternatively, only one remote communication device 14 is provided within communication range 11 during a given operation.

A communication range 11 of interrogator 12 is shown in FIG. 1. Interrogator 12 communicates with remote communication devices 14 located within communication range 11. Typically, there is no communication between multiple remote communication devices 14. Instead, remote communication devices 14 respectively communicate with interrogator 12. As previously mentioned, multiple remote communication devices 14 are typically used in the same field of interrogator 12 (i.e., within communications range 11 of interrogator 12).

Figure 3:
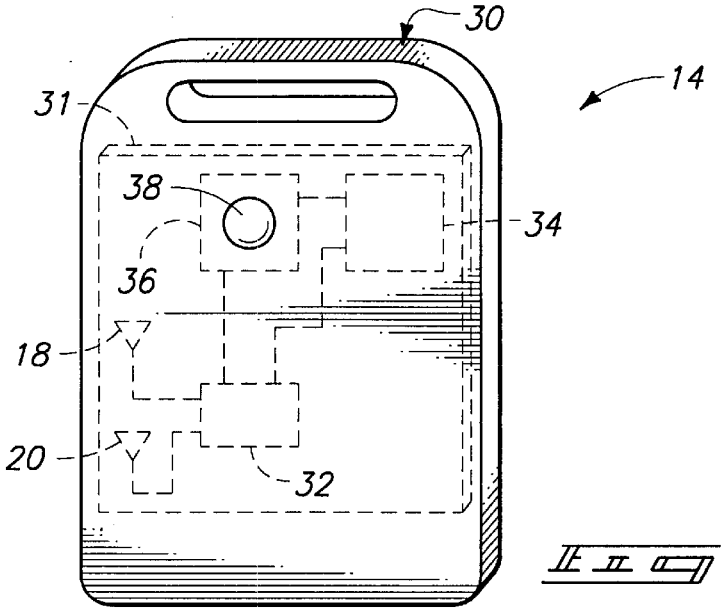
FIG. 3 is an isometric view of an exemplary remote communication device of the wireless communication system shown in FIG. 1.

It may be beneficial to determine communication range 11 of interrogator 12 in a given application. As described below, one aspect of the disclosure provides a remote communication device 14 having indication circuitry (one configuration is shown in FIG. 3) configured to assist with the determination of communication range 11 during testing operations. Such a remote configuration device 14 can comprise a device utilized for normal communication and/or testing operations, or alternatively, for testing operations only.

During testing operations, remote communication device 14 having the indication circuitry of FIG. 3 can be moved throughout an area larger than and including communication range 11 to assist with the determination of communication range 11. Interrogator 12 can be utilized to output plural forward link wireless signals 22 during testing operations. Remote communication device 14 operates to output a human perceptible signal (e.g., human visible light) as described below when it is present within communication range 11 and receiving forward link wireless signals 22. Such human perceptible signals can be used to assist with determining communication range 11 of interrogator 12 by noting where such human perceptible signals are generated as remote communication device 14 is moved about.

In addition, remote communication device 14 can be utilized to verify correct installation and operation of wireless communication system 10. Remote communication device 14 indicates proper operation and installation of interrogator 12 responsive to receiving forward link wireless signals 22.

During some operations, transmit functions of remote communication device 14 may be disabled. In addition, remote communication device 14 may be utilized as the only communication device 14 within communication range 11 during testing or other operations. Alternatively, plural remote communication devices 14 are provided within communication range 11 as previously described.

In the described embodiment, wireless communication system 10 is configured as an electronic identification system. Other configurations of wireless communication system 10 are possible. Remote communication devices 14 can be individually associated with respective objects 16, such as packages in inventory. Wireless communication system 10 can also be used in other applications including other identification applications.

Although remote communication devices 14 depicted in FIG. 1 are associated with respective objects 16, it is to be understood that one or more remote communication devices 14 may be provided within communication range 11 without an associated object 16. An exemplary application can include utilization of such an unassociated remote communication device 14 to determine communication range 11 of wireless communication system 10.

Remote communication devices 14 individually comprise a wireless identification device in the described arrangement. Other configurations of remote communication devices 14 are possible. An exemplary wireless identification device is a radio frequency identification device (RFID). In the depicted configuration, remote communication devices 14 individually include an antenna 18 for wireless or radio frequency transmission by the respective remote communication device 14. Remote communication devices 14 further individually include an antenna 20 for wireless or radio frequency reception by the respective remote communication device 14. In one embodiment, the antennas 18, 20 are microstrip antennas.

Individual remote communication devices 14 transmit and receive radio frequency communications to and from interrogator 12. An exemplary interrogator is described in commonly assigned U.S. patent application Ser. No. 08/907,689, filed Aug. 8, 1997, now abandoned, and incorporated herein by reference. Preferably, interrogator 12 includes an antenna 13 as well as dedicated transmitting and receiving circuitry. In one embodiment, such circuitry is complementary to that implemented within individual remote communication devices 14.

Radio frequency identification has emerged as a viable system for tagging or labeling small to large quantities of objects 16. In the described configuration, interrogator 12 and remote communication devices 14 communicate via an electromagnetic link, such as via an RF link (e.g., at microwave frequencies, in one embodiment), so all transmissions by interrogator 12 are heard by remote communication devices 14 within communication range 11. Interrogator 12 transmits forward link wireless signals 22 individually comprising an interrogation signal or command via antenna 13.

Figure 2:
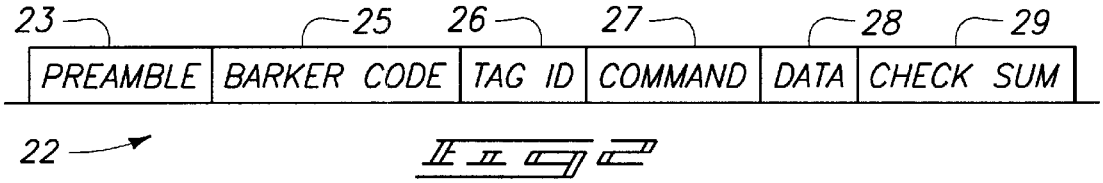
FIG. 2 is a diagrammatic representation of an exemplary forward link wireless signal outputted from an interrogator of the wireless communication system shown in FIG. 1.

Referring to FIG. 2, an exemplary forward link wireless signal 22 is shown. The depicted forward link wireless signal 22 includes a preamble 23, barker code 25, tag identifier (ID) 26, command 27, data 28 and check sum 29. Tag identifier 26 can comprise an identifier to identify one or more of remote communication devices 14 in some applications. For example, tag identifier 26 can identify one, more than one, or all of remote communication devices 14. As described below, typically only the remote communication devices 14 identified within tag identifier 26 process the respective command 27 and data 28.

Referring again to FIG. 1, remote communication devices 14 within the appropriate communication range 11 individually receive the incoming interrogation forward link wireless signal 22 via respective antennas 20. Upon receiving wireless signal 22, individual remote communication devices 14 can respond by generating a response signal and transmitting a return link wireless signal 24 via respective antenna 18. The return link communication signal 24 typically includes information that uniquely identifies, or labels the particular remote communication device 14 that is transmitting. Such may operate to identify a respective object 16 with which the responding remote communication device 14 is associated. Exemplary objects 16 include packages in inventory, people, automobiles, animals, etc. In some configurations, transmit antenna 18 may be disabled to prevent the emission of the return link wireless signal 24.

Referring to FIG. 3, remote communication device 14 can be included in any appropriate packaging or housing 30. Various methods of manufacturing housings are described in commonly assigned U.S. patent application Ser. No. 08/800,037, filed Feb. 13, 1997 now U.S. Pat. No. 5,988,510, and incorporated herein by reference. An exemplary housing 30 includes an ultrasonically welded plastic injection molded case. Housing 30 is provided about a substrate 31 and at least some of the circuitry of remote communication device 14. Housing 30 can be configured as a case about substrate 31 to enclose most if not all of the internal components of remote communication device 14. More specifically, circuitry of remote communication device 14 is provided upon substrate 31 in one embodiment. An exemplary substrate 31 is FR4 board. Circuit components of remote communication device 14 may be attached to substrate 31 using pick-and-place processing techniques.

FIG. 3 shows but one embodiment of remote communication device 14 in the form of a card or badge including housing 30 of plastic or other suitable material. In one embodiment, a face of housing 30 has visual identification features such as graphics, text, information found on identification or credit cards, etc. (not shown). Housing 30 can also be formed as a miniature housing encasing the internal circuitry and power supply to define a tag which can be supported by object 16 (e.g., hung from an object, affixed to an object, etc.). Other forms of housings 30 are employed in alternative embodiments.

In the illustrated embodiment, remote communication device 14 includes communication circuitry 32, a power source 34 and indication circuitry 36. Communication circuitry 32 includes a small outline integrated circuit (SOIC) as described in the above-incorporated patent application Ser. No. 08/705,043, filed Aug. 29, 1996. Exemplary communication circuitry 32 is available from Micron Communications Inc., 3176 South Denver Way, Boise, Id. 83705 under the trademark Microstamp Engine (TM) and having designations MSEM256X10SG, MT59RC256R1FG-5. Other embodiments of communication circuitry 32 are possible. Power source 34 is connected to supply power to communication circuitry 32 and indication circuitry 36.

In one embodiment, power source 34 comprises one or more batteries. Individual batteries can take any suitable form. Preferably, the battery type will be selected depending on weight, size, and life requirements for a particular application. In one embodiment, a suitable battery is a thin profile button-type cell forming a small and thin energy cell more commonly utilized in watches and small electronic devices requiring a thin profile. A conventional button-type cell has a pair of electrodes, an anode formed by one face and a cathode formed by an opposite face. In an alternative embodiment, power source 34 comprises a series connected pair of button type cells. In alternative embodiments, other types of suitable power source are employed. Suitable batteries of power source 34 individually include a 3 Volt battery having designation CR2016 available from Eveready Battery Co. Two such batteries can be coupled in series for a 6 Volt output of power source 34 in one embodiment.

In the described arrangement, communication circuitry 32 is coupled with substrate 31 and is configured to at least one of receive wireless signals and communicate wireless signals. Exemplary received and communicated wireless signals comprise radio frequency signals as previously described. In one embodiment, communication circuitry 32 comprises transponder circuitry configured to output the reply or return link wireless identification signal responsive to the reception of a forward link wireless interrogation signal generated within interrogator 12.

Indication circuitry 36 is coupled with substrate 31 and communication circuitry 32. In the described embodiment, indication circuitry 36 includes an indicator 38 to indicate operation of remote communication device 14. Remote communication device 14 can be configured such that indication circuitry 36 indicates at least one of reception of wireless signals and generation of a response signal. Indication circuitry 36 may also be configured to indicate the outputting of wireless signals from remote communication device 14.

Remote communication device 12 having indication circuitry 38 can also be configured to provide additional indication operations in addition to those described herein. Exemplary additional indication operations of remote communication device 12 are described in a commonly assigned U.S. Patent Application entitled "Radio Frequency Identification Devices, Remote Communication Devices, Identification Systems, Communication Methods, and Identification Methods", naming Scott T. Trosper as inventor, filed the same day as the present application, having a U.S. patent application Ser. No. 09/364,249 incorporated herein by reference, and in a commonly assigned U.S. Patent Application entitled "Radio Frequency Identification Devices, Remote Communication Devices, Wireless Communication Systems, and Methods of Indicating Operation", naming Scott T. Trosper as inventor, filed the same day as the present application, having a U.S. patent application Ser. No. 09/363,945 and incorporated herein by reference.

Indication circuitry 36 includes indicator 38 configured to emit a human perceptible signal to indicate operation of the remote communication device 14 in accordance with a preferred configuration. In the described embodiment, indicator 38 is configured to visually indicate operation of remote communication device 14. In particular, indicator 38 can include at least one light emitting device, such as a light emitting diode (LED), to emit a signal visually perceptible to humans. An exemplary LED has designation L20265-ND and is available from Digi-Key Corp. Indication circuitry 36 can also include other indicators 38 for indicating operation of remote communication device 14. Another exemplary indicator 38 includes an audible device, such as a buzzer. Indicator 38 can have other configurations.

Preferably, remote communication device 14 is configured such that indicator 38 of indication circuitry 36 outwardly emits the human perceptible signal or otherwise indicates operation outside of housing 30. For example, indicator 38 may extend through housing 30 as shown and is externally visible. In the depicted arrangement, housing 30 is provided about substrate 31 and internal circuitry with indication circuitry 36 at least partially outwardly exposed as illustrated.

Figure 4:
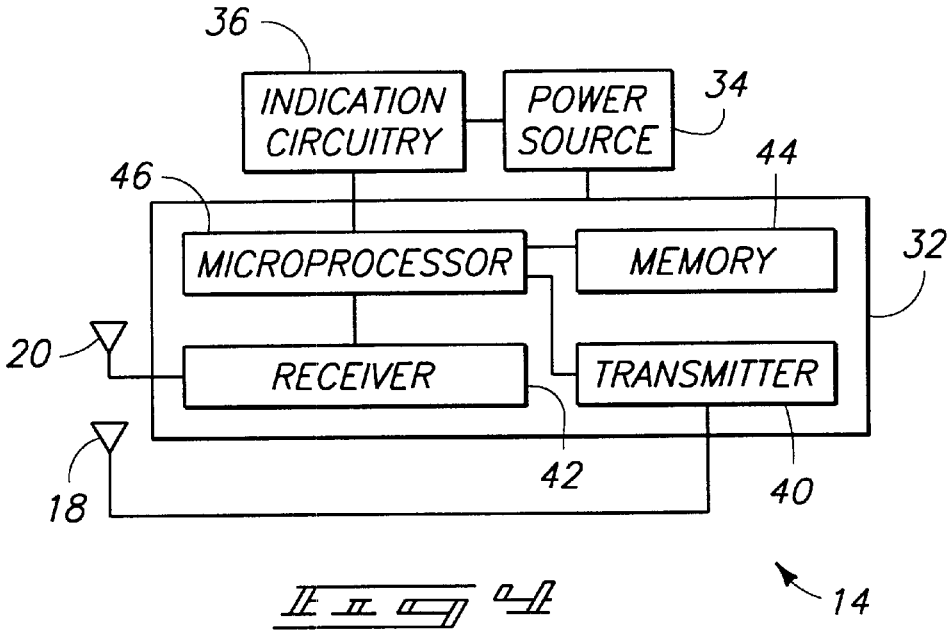
FIG. 4 is a functional block diagram of internal circuitry according to one configuration of the remote communication device.

Referring to FIG. 4, communication circuitry 32 of remote communication device 14 includes a single die in accordance with the described embodiment having a transmitter 40, a receiver 42, a memory 44, and a microprocessor 46. Microprocessor 46 is coupled to transmitter 40, receiver 42, and memory 44 as described in U.S. patent application Ser. No. 08/705,043. In one configuration, transmitter 40 is configured to reply using wireless communications. Such can include backscatter communications. Alternatively, transmitter 40 may be disabled (e.g., in some testing operations).

Forward link wireless signals 22 are received within antenna 20 and applied to receiver 42. The forward link wireless signals 22 can be specific to individual remote communication devices 14, or intended to apply to some or all remote communication devices 14 within communication range 11.

Microprocessor 46 is configured to process the signals received by receiver 42. Responsive to the content of a received forward link wireless signal 22, microprocessor 46 can formulate a response signal which is applied to transmitter 40 and emitted as the return link wireless signal 24 if transmit antenna 18 is enabled. The response signal can include modulation to provide modulated backscatter communications. Transmitter 40 operates to output return link wireless signals 24 using antenna 18. As previously described, transmitter 40 may be configured for backscatter communications. For example, antenna 18 can be configured as a dipole antenna and transmitter 40 can selectively short halves of the dipole antenna configuration to selectively reflect a continuous wave signal generated by interrogator 12.

Figure 5:
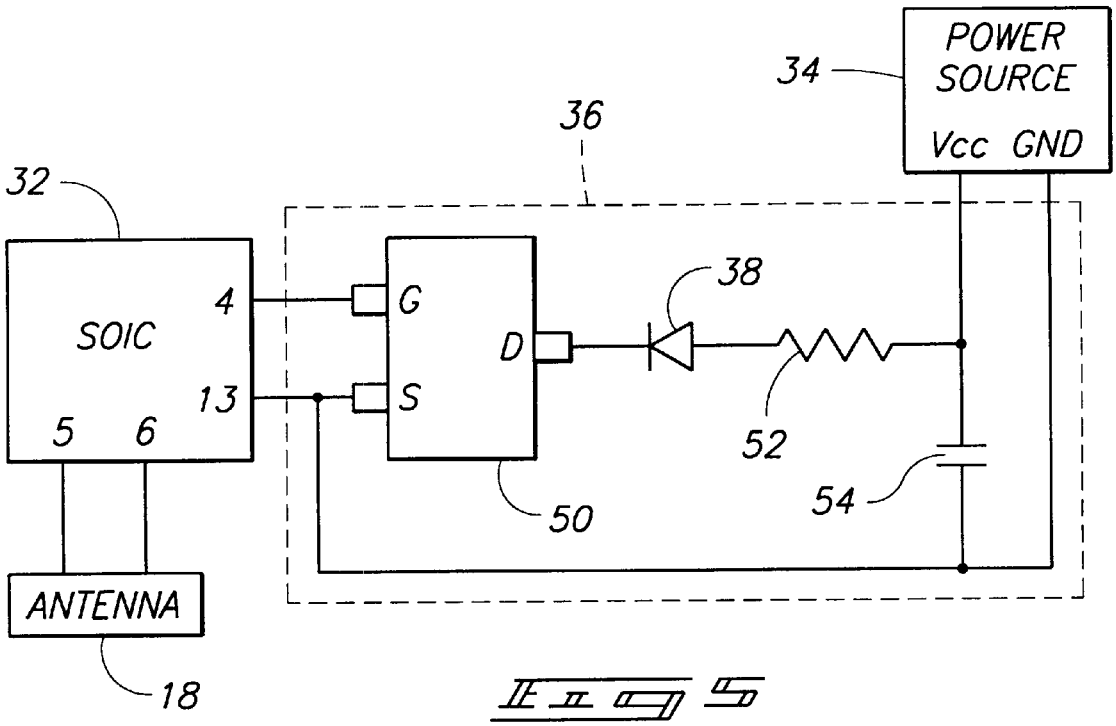
FIG. 5 is an illustrative representation of exemplary indication circuitry of the remote communication device of FIG. 4.
Figure 3:
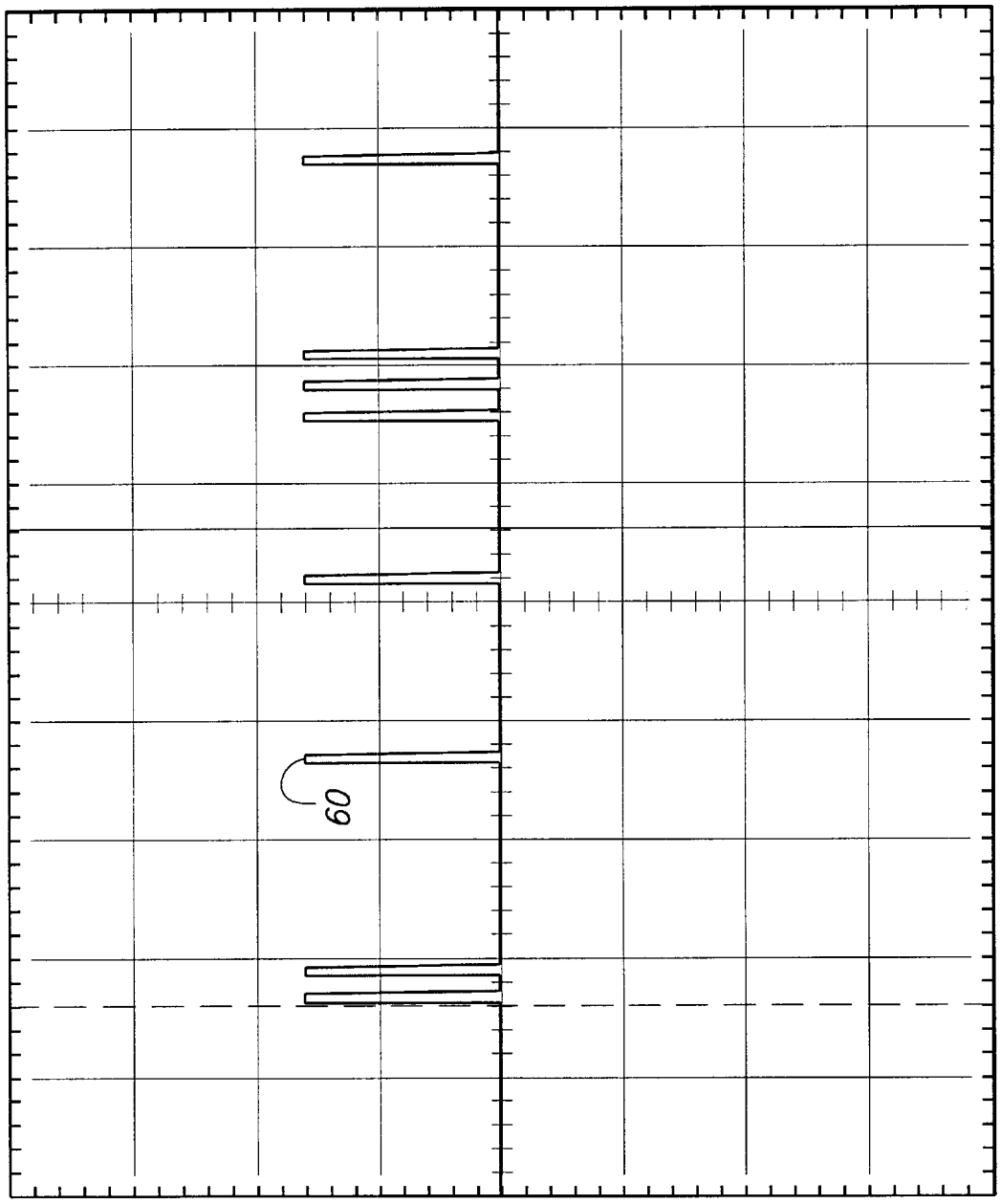
Figure 4:
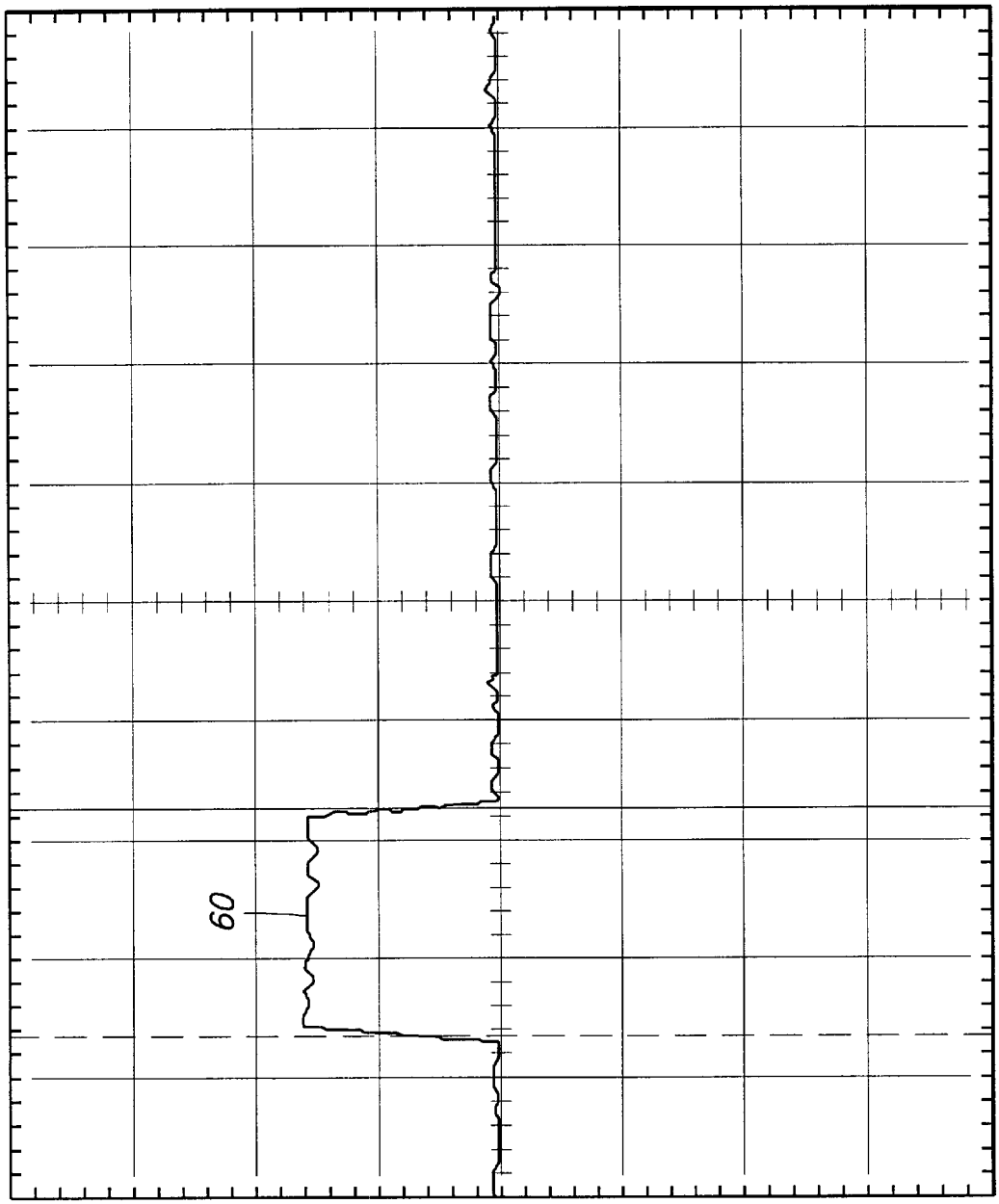

Referring to FIG. 5, operations of communication circuitry 32 and indication circuitry 36 are described. The SOIC of communication circuitry 32 includes plural pin connections, some of which are illustrated in FIG. 5. For example, a pin 4 is coupled with an internal current source (not shown) which is configured to output a response signal, such as a current signal, to provide backscatter communications. The response signal outputted from pin 4 corresponds to the control signal utilized to control modulation of the continuous wave signal during backscatter communications.

Plural pins 5, 6 of communication circuitry 32 can be coupled with antenna 18. In one embodiment, pins 5, 6 can be coupled with respective halves of the dipole antenna configuration to implement backscatter communications. Internal of the SOIC, a switch (not shown) selectively shorts pins 5, 6 to implement the appropriate backscatter modulation communications corresponding to the response signal. A pin 13 of communication circuitry 32 is a ground voltage reference pin.

In the depicted arrangement, pins 4, 13 are coupled with indication circuitry 36. The depicted indication circuitry 36 includes indicator 38, transistor 50, resistor 52 and capacitor 54 arranged as illustrated. In an exemplary configuration, capacitor 54 is a 0.1 $\mu$F SmT capacitor having designation PCC104BCT-ND available from DigiKey Corp. and resistor 52 is a 620 Ohm ⅛th Watt SmT resistor having designation P620ETR-ND available from Digi-Key Corp. Transistor 50 is a ZVN3306FCT-ND N-Channel MOSFET transistor available from Digi-Key Corp.

During exemplary operations, remote communication device 14 including indication circuitry 36 can be moved within an area including communication range 11. Interrogator 12 can be provided in a mode to continually transmit an identify command which prompts a return message from all remote communication devices 14 within communication range 11. In such a test mode, remote communication device 14 having indication circuitry 36 configured as shown can assist with the determination of communication range 11.

For example, following the receipt and processing by microprocessor 46 of forward link wireless signal 22 having an appropriate tag identifier 26 and identify command 27, remote communication device 14 formulates a response signal and a return link wireless signal 24 if antenna 18 is enabled. Microprocessor 46 formulates a response signal corresponding to return link wireless signal 24 and transmitter 40 is configured to output the return link wireless signal 24 according to the response signal from microprocessor 46. The response signal from microprocessor 46 is also applied via pin 4 to indication circuitry 36. During some testing operations, wireless communications via antenna 18 can remain enabled or, alternatively, be disabled if return link communication signals are undesired.

Microprocessor 46 outputs the response signal in the form of a current signal via pin 4 to indication circuitry 36. Pin 4 can be coupled with the gate (G) of transistor 50. Responsive to the gate receiving current from pin 4, the drain (D) connection is coupled with the source (S) connection of transistor 50. Such closes the circuitry within indication circuitry 36 and illuminates indicator 38 comprising a light emitting device. A typical response signal from microprocessor 46 is 20 ms in the described embodiment. Such results in a visible flashing of indicator 38 in the described embodiment corresponding to received forward link wireless signals 22.

Accordingly, the indication of operations of remote communication device 14 using indicator 38 is responsive to processing of forward link wireless signal 22 and generation of a response signal corresponding to the return link wireless signal. Other configurations for controlling indicator 38 are possible. Further, the duration of the return link wireless signal can be adjusted in other configurations to vary the length of the indicating signal using indication circuitry 36.

Referring to FIG. 6, a graph illustrates an exemplary testing operation using a remote communication device 14 having indication circuitry 36 to determine communication range 11 of interrogator 12 in one application. Time progresses from left to right in the graph of FIG. 6. A voltage across resistor 52 of indication circuitry 36 is represented in the vertical direction.

Remote communication device 14 can be moved throughout an area adjacent wireless communication system 10. During such movements, remote communication device 14 may be moved in and out of communication range 11. Such results in the reception of only some of the forward link wireless signals 22 being continually generated using interrogator 12 during testing operations. Accordingly, the generation of responses from microprocessor 46 corresponds to received forward link wireless signals 22 while remote communication device 14 is moved within communication range 11.

The generation of a response signal corresponding to return link wireless signal 24 results in a spike 60. The divisions of the illustrated graph are approximately 250 ms and individual spikes 60 are approximately 20 ms in length corresponding to the duration of response signals from microprocessor 46 for generating return link wireless signals 24. The generation of response signals depends upon the movement of the remote communication device 14 with respect to communication range 11. Spikes 60 correspond to remote communication device 14 being within communication range 11. As illustrated, indicator 38 generates some emissions responsive to continuous generation of forward link wireless signals 22 from interrogator 12 and responsive to remote communication device 14 being moved in and out of communication range 11.

Spikes 60 correspond to response signals from microprocessor 46 and to the emission of light from indicator 38. Such can be utilized by an individual to visually determine the boundaries of communication range 11 of interrogator 12 in a given application. The number of spikes 60 (i.e., outputted as flashes of light from indicator 38 in the described configuration) increases with increasing field strength.

Referring to FIG. 7, one spike 60 is illustrated in detail. Again, time increases in the illustrated graph of FIG. 7 from left to right. The voltage across resistor 52 of indication circuitry 36 is indicated in the vertical direction. Some modulation upon the top portion of spike 60 results due to backscatter modulation of the response signal outputted by microprocessor 46 from pin 4 of communication circuitry 32. However, the capacitive effect of the gate pin of transistor 50 minimizes such modulation effects upon the operation of indication circuitry 36.

Figure 8:
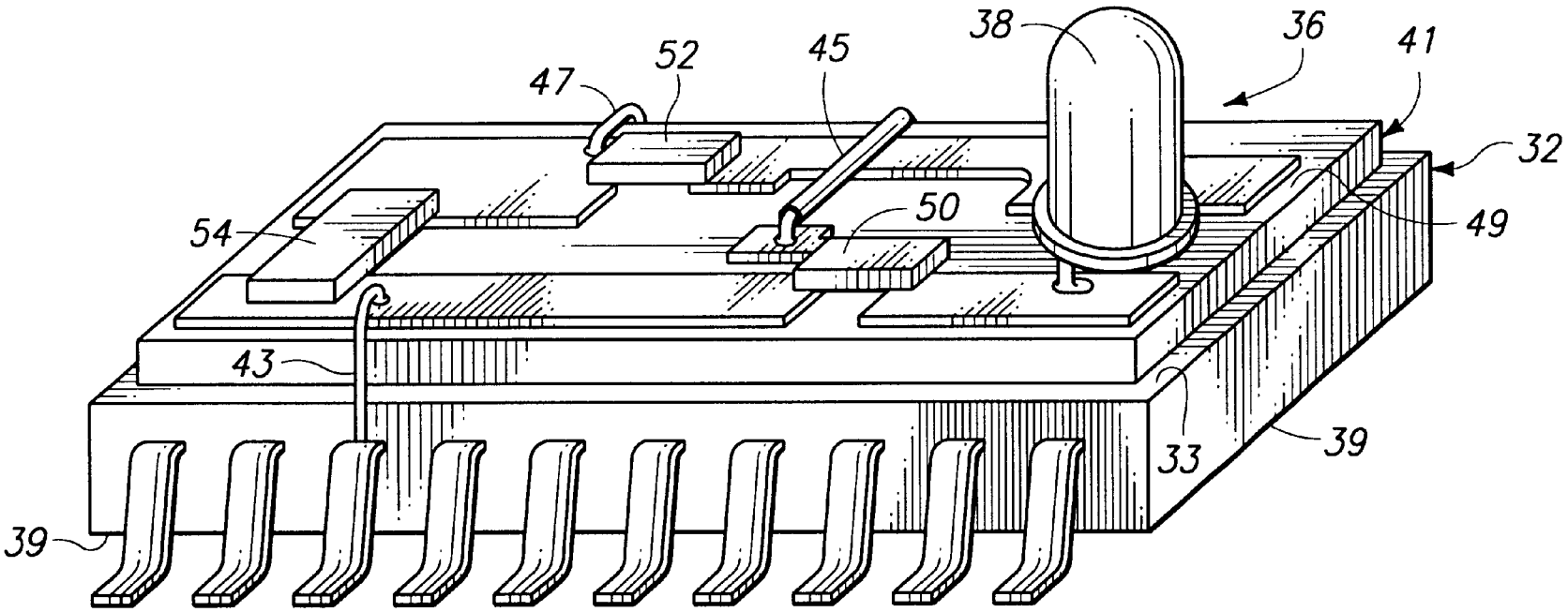
FIG. 8 is an isometric view of one configuration of the indication circuitry shown in FIG. 5.

Referring to FIG. 8, SOIC communication circuitry 32 is shown coupled with components of indication circuitry 36. More specifically, indicator 38, transistor 50, resistor 52, and capacitor 54 are provided upon a PC board 41. PC board 41 is attached in one embodiment to an upper surface 33 of SOIC communication circuitry 32 using Cyandacrylate adhesive. PC board 41 additionally includes copper clad traces upon an upper surface 49 to connect components of indication circuitry 36.

Wire connections 43, 45 couple pins of SOIC communication circuitry 32 with various components of indication circuitry 36. Wire connection 43 couples transistor 50 and capacitor 54 with a ground pin 13 of SOIC communication circuitry 32. Wire connection 45 couples transistor 50 with pin 4 of SOIC communication circuitry 32. An additional wire connection 47 couples resistor 52 and capacitor 54 with a positive reference voltage of power source 34.

As depicted, SOIC communication circuitry 32 defines a footprint corresponding to a perimeter 39 of the SOIC package. Components of indication circuitry 36 and conductive traces of PC board 41 are preferably provided within perimeter 39 of the SOIC package to minimize effects of such circuitry upon wireless communications of remote communication device 14.

Figure 9:
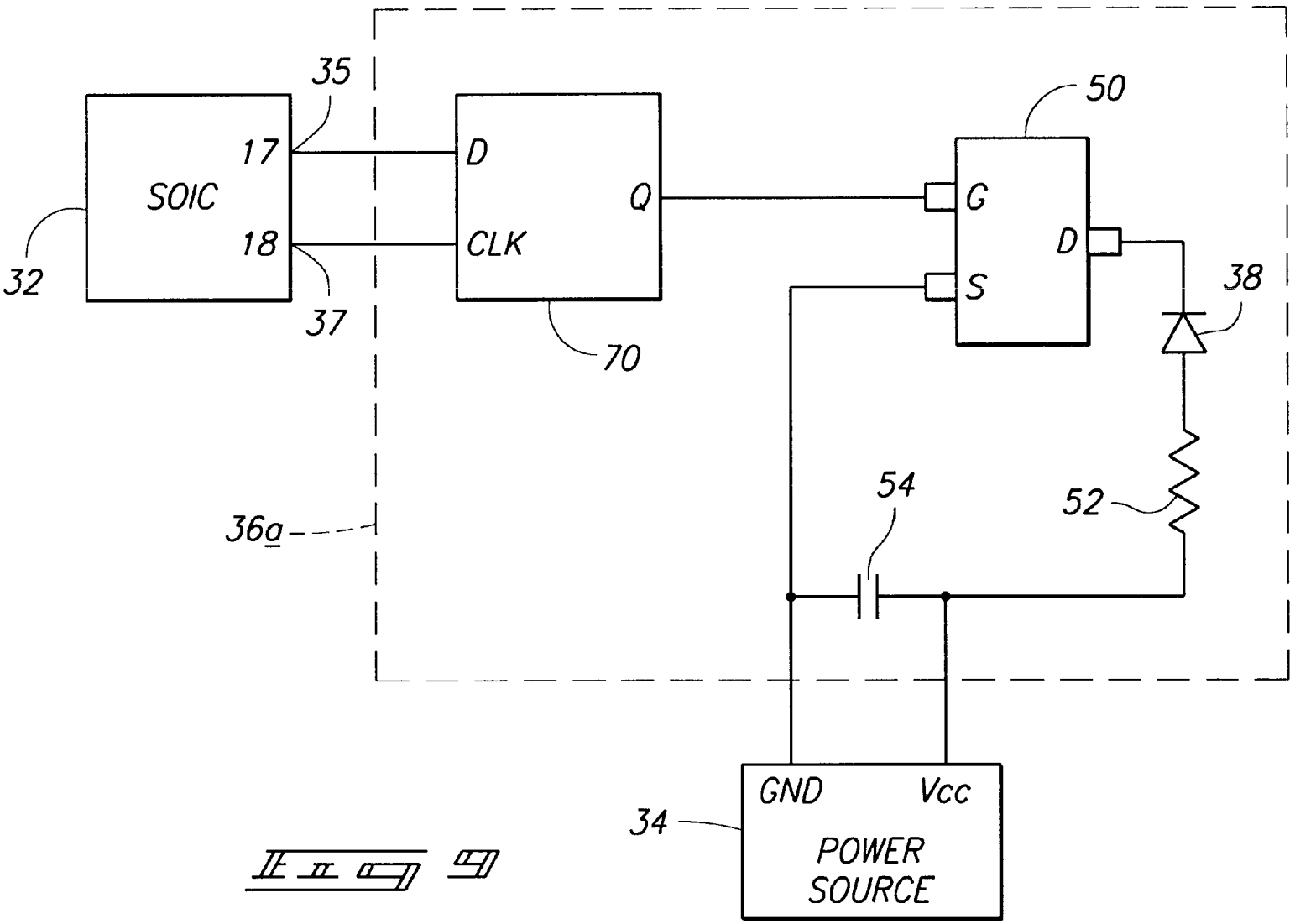
FIG. 9 is an illustrative representation of another configuration of indication circuitry of the remote communication device.

Referring to FIG. 9, an alternative configuration of indication circuitry 36*a* of remote communication device 14 is illustrated. The depicted indication circuitry 36*a* is coupled with communication circuitry 32 and power source 34. Indication circuitry 36*a* can be utilized alone or in combination with indication circuitry 36 described with reference to FIG. 5 above.

Indication circuitry 36*a* is coupled with a data port 35 and a clock output 37 of communication circuitry 32. Port 35 and clock output 37 can respectively comprise pins 17, 18 of the SOIC. Port 35 can comprise a digital port and clock output 37 can comprise a digital clock output. The depicted indication circuitry 36*a* includes a latch 70, transistor 50, indicator 38, resistor 52 and capacitor 54.

Indication circuitry 36*a* provides benefits in numerous applications, such as inventory monitoring,as n exemplary application. In particular, assuming there are a plurality of objects 16 which are being monitored, remote communication device 14 containing indication circuitry 36*a* can be utilized to identify one of more desired specific objects from the remaining objects within inventory.

For example, referring again to FIG. 2, a user can input a desired identifier within tag identifier 26 of forward link wireless signal 22. The identifier can correspond to a desired object 16 associated with the remote communication device 14 identified by tag identifier 26. Tag identifier 26 can identify one or more desired remote communication devices 14 to identify one or more objects 16.

Interrogator 12 communicates the forward link wireless signal 22 having the proper identifier 26 within communication range 11. Remote communication devices 14 within communication range 11 receive the forward link wireless signal 22 including identifier 26. Individual remote communication devices 14 receiving forward link wireless signal 22 process the received forward link wireless signal 22. Individual remote communication devices 14 identified by the tag identifier 26 proceed to process command 27. Other remote communication devices 14 not identified by tag identifier 26 discard the received forward link wireless signal 22.

Command 27 within forward link wireless signal 22 can include a command to write to port 35 of communication circuitry 32. Following processing of command 27, communication circuitry 32 can generate and output a control signal to indication circuitry 36*a*. Indication circuitry 36*a* is configured to receive the control signal and to indicate the operation and presence of the respective remote communication device 14 responsive to the control signal.

In one configuration, communication circuitry 32 is configured to output a control signal to indication circuitry 36*a* comprising data 28 of a received forward link wireless signal 22. More specifically, command 27 can specify the writing of data 28 contained within received forward link wireless signal 22 to port 35 of communication circuitry 32. Data 28 can comprise a byte for controlling indication circuitry 36*a*. For example, data 28 can include hex FF to turn on indicator 38. Thereafter, interrogator 12 can communicate another forward link wireless signal 22 including hex 00 within data 28. Writing of the hex 00 to data port 35 can be utilized to turn off indicator 38. Other data 28 can be supplied within a forward link wireless signal 22.

Data port 35 is coupled with a D-input of latch 70. Communication circuitry 32 is configured to output a timing signal to a clock (CLK) input of latch 70 via clock output 37. Latch 70 of indication circuitry 36*a* is configured to receive the control signal including data 28 from communication circuitry 32. Latch 70 is configured to store data 28 received from communication circuitry 32. Further, latch 70 is configured to selectively assert an output signal via the Q-output responsive to the received control signal in the described embodiment. The Q-output is coupled with gate (G) electrode of transistor 50. The source (S) electrode of transistor 50 is coupled with ground and the drain (D) electrode of transistor 50 is coupled with indicator 38.

Indicator 38 is selectively coupled with latch 70 via transistor 50 and is configured to output a signal to indicate the operation and presence of the respective remote communication device 14 responsive to the control signal (e.g., data 28) received within latch 70 from communication circuitry 32. As described above, indicator 38 is preferably configured to emit a human perceptible signal to indicate the presence of the respective remote communication device 14. In the depicted embodiment, indicator 38 comprises a light emitting device such as a light emitting diode (LED) configured to visually indicate the operation and presence of the respective remote communication device 14.

In accordance with the presently described embodiment, only the remote communication devices 14 identified by identifier 26 of forward link wireless signal 22 indicate operation and presence using indication circuitry 36*a*. Accordingly, such operates to identify desired objects 16 from other objects 16 according to one application.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A wireless communication device comprising:

a substrate;

communication circuitry coupled with the substrate and configured to receive wireless signals and communicate backscatter wireless signals; and indication circuitry coupled with the communication circuitry and configured to indicate operation of the wireless communication device.

2. The device according to claim 1 wherein the indication circuitry is configured to indicate at least one of reception of wireless signals and generation of wireless signals.

3. The device according to claim 1 wherein the indication circuitry comprises at least one light emitting device.

4. The device according to claim 1 wherein the communication circuitry comprises transponder circuitry.

5. The device according to claim 1 further comprising a housing over the substrate and the indication circuitry is configured to emit a human perceptible signal outside of the housing to indicate the operation.

6. The device according to claim 1 wherein the communication circuitry includes an integrated circuit defining a perimeter and the indication circuitry is provided within the perimeter.

7. The device according to claim 1 wherein the communication circuitry comprises radio frequency identification device communication circuitry.

8. The device according to claim 1 wherein the indication circuitry is configured to emit a human perceptible signal to indicate operation.

9. A wireless communication device comprising:

a substrate;

communication circuitry coupled with the substrate and configured to communicate wireless signals comprising backscatter signals;

indication circuitry coupled with the communication circuitry and the indication circuitry is configured to emit a human perceptible signal to indicate operation of the wireless communication device; and a self-contained power source coupled with the substrate and configured to supply electrical energy to the communication circuitry and the indication circuitry.

10. The device according to claim 9 wherein the indication circuitry is configured to indicate at least one of reception of wireless signals and generation of wireless signals.

11. The device according to claim 9 wherein the indication circuitry is configured to emit a human visible signal to indicate operation of the wireless communication device.

12. The device according to claim 9 wherein the indication circuitry comprises at least one light emitting device.

13. The device according to claim 9 further comprising a housing over the substrate and the indication circuitry is configured to emit the human perceptible signal outside of the housing.

14. The device according to claim 9 wherein the communication circuitry includes an integrated circuit defining a perimeter and the indication circuitry is provided within the perimeter.

15. The device according to claim 9 wherein the communication circuitry comprises radio frequency identification device communication circuitry.

16. The device according to claim 9 wherein the power source comprises a battery.

17. A wireless communication system comprising:

an interrogator configured to output a wireless interrogation signal; and a wireless communication device configured to communicate with the interrogator and including:

communication circuitry configured to receive the wireless interrogation signal and to communicate a wireless identification signal comprising a backscatter signal; and indication circuitry coupled with the communication circuitry and configured to indicate operation of the device and to not output any radio frequency signals during the indication.

18. The system according to claim 17 wherein the indication circuitry is configured to emit a human perceptible signal to indicate operation of the wireless communication device.

19. The system according to claim 17 wherein the indication circuitry is configured to emit a human visible signal to indicate operation of the wireless communication device.

20. The system according to claim 17 wherein the indication circuitry is configured to indicate at least one of reception of wireless interrogation signals and generation of wireless identification signals.

21. The system according to claim 17 wherein the indication circuitry comprises at least one light emitting device.

22. The system according to claim 17 further comprising a housing over the substrate and the indication circuitry is configured to emit a human perceptible signal outside of the housing to indicate the operation.

23. The system according to claim 17 wherein the communication circuitry includes an integrated circuit defining a perimeter and the indication circuitry is provided within the perimeter.

24. The device according to claim 17 wherein the wireless communication device comprises a radio frequency identification device.

25. A communication method comprising:

providing a wireless communication device including a housing about at least a portion of indication circuitry and the wireless communication device further including a self-contained power source configured to supply electrical energy to the indication circuitry;

receiving a wireless signal within the wireless communication device;

indicating operation of the wireless communication device externally of the housing using the indication circuitry after the receiving; and outputting a wireless signal comprising a backscatter signal using the wireless communication device after the receiving.

26. The method according to claim 25 wherein the indicating is responsive to at least one of the receiving and the outputting.

27. The method according to claim 26 further comprising outputting a wireless signal responsive to the outputting.

28. The method according to claim 25 wherein the providing comprises providing a wireless communication device including indication circuitry comprising a light emitting device and the indicating comprises emitting human visible light using the light emitting device.

29. The method according to claim 25 further comprising processing the wireless signal after the receiving and the indicating is responsive to the processing.

30. The method according to claim 25 wherein the providing comprises providing a radio frequency identification device.

31. The method according to claim 25 wherein the providing the power source comprises providing a battery.

32. A communication method comprising:

providing a wireless communication device having indication circuitry;

receiving a wireless signal within the wireless communication device;

emitting a human perceptible signal using the indication circuitry to indicate operation of the wireless communication device after the receiving; and outputting a backscatter signal using the wireless communication device after the receiving.

33. The method according to claim 32 further comprising generating a response signal using the wireless communication device and the emitting is responsive to at least one of the receiving and the generating.

34. The method according to claim 33 further comprising outputting the backscatter signal responsive to the generating.

35. The method according to claim 32 wherein the emitting comprises emitting a human visible signal.

36. The method according to claim 32 wherein the emitting comprises emitting using a light emitting device.

37. The method according to claim 32 further comprising processing the wireless signal and wherein the emitting is responsive to the processing.

38. The method according to claim 32 wherein the providing comprises providing a radio frequency identification device.

39. A communication method comprising:

providing a wireless communication system including an interrogator and a wireless communication device including communication circuitry and indication circuitry;

outputting a wireless signal using the interrogator;

receiving the wireless signal within the communication circuitry;

indicating operation of the wireless communication device using the indication circuitry after the receiving and while not outputting any radio frequency signals; and outputting a wireless signal comprising a backscatter signal using the communication circuitry after the receiving.

40. The method according to claim 39 wherein the indicating comprises emitting a human perceptible signal.

41. The method according to claim 39 wherein the indicating comprises emitting a human visible signal.

42. The method according to claim 39 wherein the indicating comprises emitting using a light emitting device.

43. The method according to claim 39 wherein the indicating is responsive to at least one of the receiving and the outputting.

44. The method according to claim 43 wherein the providing comprises providing a radio frequency identification device.

45. The method according to claim 39 further comprising processing the wireless signal, and the indicating is responsive to the processing.

46. The method according to claim 39 wherein the providing comprises providing a radio frequency identification device.

47. A method of forming a radio frequency identification device comprising:

providing a housing;

supporting radio frequency identification device communication circuitry using the housing;

providing indication circuitry within the housing and configured to indicate operation of the communication circuitry externally of the housing; and coupling the indication circuitry with the communication circuitry.

48. The method according to claim 47 wherein the providing the housing comprises providing the housing about at least a portion of a substrate with the indication circuitry at least partially outwardly exposed.

49. The method according to claim 47 wherein the providing indication circuitry comprises providing a light emitting device.

50. The method according to claim 47 wherein the providing indication circuitry comprises providing circuitry configured to emit a human perceptible signal.

51. The method according to claim 47 wherein the providing communication circuitry comprises providing transponder circuitry.

52. The method according to claim 47 wherein the supporting comprises supporting the communication circuitry configured to implement backscatter communications.

53. The method according to claim 44 wherein the supporting communication circuitry comprises supporting radio frequency identification device communication circuitry.

54. A method of testing wireless communication operations of a wireless identification system comprising:

providing a wireless communication device comprising a radio frequency identification device having indication circuitry;

outputting a wireless signal;

receiving the wireless signal within the wireless communication device; and indicating the receiving using the indication circuitry of the wireless communication device and while not outputting any radio frequency signals.

55. The method according to claim 54 further comprising generating a response signal using the wireless communication device and the indicating is responsive to at least one of the receiving and the generating.

56. The method according to claim 54 wherein the indicating comprises emitting a human perceptible signal.

57. The method according to claim 54 wherein the indicating comprises emitting a human visible signal.

58. The method according to claim 54 wherein the indicating comprises emitting light using a light emitting device.

59. The method according to claim 54 further comprising processing the wireless signal after the receiving and the indicating is responsive to the processing.

60. The method according to claim 54 wherein the providing comprises providing a wireless communication device having a self-contained power source configured to supply electrical energy to the indication circuitry.

61. A radio frequency identification device comprising:

a substrate;

communication circuitry coupled with the substrate and configured to at least one of receive wireless signals and communicate wireless signals; and indication circuitry coupled with the communication circuitry and configured to indicate operation of the radio frequency identification device, wherein the communication circuitry includes an integrated circuit defining a perimeter and the indication circuitry is provided within the perimeter.

62. A radio frequency identification device comprising:

a substrate;

communication circuitry coupled with the substrate and configured to at least one of receive wireless signals and communicate wireless signals; and indication circuitry coupled with the communication circuitry and the indication circuitry is configured to emit a human perceptible signal to indicate operation of the radio frequency identification device, wherein the communication circuitry includes an integrated circuit defining a perimeter and the indication circuitry is provided within the perimeter.

63. A radio frequency identification device comprising:

a substrate;

radio frequency identification device communication circuitry coupled with the substrate and configured to at least one of receive wireless signals and communicate wireless signals;

indication circuitry coupled with the communication circuitry and configured to indicate operation of the radio frequency identification device; and a housing over the substrate and the indication circuitry is configured to emit a human perceptible signal outside of the housing to indicate the operation.

64. A radio frequency identification device comprising:

a substrate;

radio frequency identification device communication circuitry coupled with the substrate and configured to at least one of receive wireless signals and communicate wireless signals; and indication circuitry coupled with the communication circuitry and configured to indicate operation of the radio frequency identification device, and wherein the communication circuitry includes an integrated circuit defining a perimeter and the indication circuitry is provided within the perimeter.

65. A radio frequency identification device comprising:

a substrate;

radio frequency identification device communication circuitry coupled with the substrate and configured to at least one of receive wireless signals and communicate wireless signals;

indication circuitry coupled with the communication circuitry and the indication circuitry is configured to emit a human perceptible signal to indicate operation of the radio frequency identification device; and a housing over the substrate and the indication circuitry is configured to emit the human perceptible signal outside of the housing.

66. A radio frequency identification device comprising:

a substrate;

radio frequency identification device communication circuitry coupled with the substrate and configured to at least one of receive wireless signals and communicate wireless signals; and indication circuitry coupled with the communication circuitry and the indication circuitry is configured to emit a human perceptible signal to indicate operation of the radio frequency identification device, and wherein the communication circuitry includes an integrated circuit defining a perimeter and the indication circuitry is provided within the perimeter.

67. A radio frequency identification device comprising:

a substrate;

radio frequency identification device communication circuitry coupled with the substrate and configured to communicate wireless backscatter signals; and indication circuitry coupled with the communication circuitry and the indication circuitry is configured to emit a human perceptible signal to indicate operation of the radio frequency identification device.

68. A wireless communication system comprising:

an interrogator configured to output a wireless interrogation signal; and a radio frequency identification device configured to communicate with the interrogator and including:

communication circuitry configured to at least one of receive the wireless interrogation signal and communicate a wireless identification signal to the interrogator;

indication circuitry coupled with the communication circuitry and configured to indicate operation of the radio frequency identification device; and a housing over the substrate and the indication circuitry is configured to emit a human perceptible signal outside of the housing to indicate the operation.

69. A wireless communication system comprising:

an interrogator configured to output a wireless interrogation signal; and a radio frequency identification device configured to communicate with the interrogator and including:

communication circuitry configured to at least one of receive the wireless interrogation signal and communicate a wireless identification signal to the interrogator; and indication circuitry coupled with the communication circuitry and configured to indicate operation of the radio frequency identification device, and wherein the communication circuitry includes an integrated circuit defining a perimeter and the indication circuitry is provided within the perimeter.

70. A wireless communication system comprising:

an interrogator configured to output a wireless interrogation signal; and a radio frequency identification device configured to communicate with the interrogator and including:

communication circuitry configured to communicate a wireless backscatter identification signal to the interrogator; and indication circuitry coupled with the communication circuitry and configured to indicate operation of the radio frequency identification device.

71. A communication method comprising:

providing a radio frequency identification device including indication circuitry;

receiving a wireless signal within the radio frequency identification device;

indicating operation of the radio frequency identification device using the indication circuitry after the receiving; and outputting a wireless signal comprising a backscatter signal using the radio frequency identification device after the receiving.

72. A communication method comprising:

providing a radio frequency identification device having indication circuitry;

receiving a wireless signal within the radio frequency identification device;

emitting a human perceptible signal using the indication circuitry to indicate operation of the radio frequency identification device after the receiving; and outputting a wireless signal comprising a backscatter signal using the radio frequency identification device after the receiving.

73. A communication method comprising:

providing a wireless communication system including an interrogator and a radio frequency identification device including communication circuitry and indication circuitry;

outputting a wireless signal using the interrogator;

receiving the wireless signal within the communication circuitry;

indicating operation of the radio frequency identification device using the indication circuitry after the receiving; and outputting a wireless signal comprising a backscatter signal using the communication circuitry of the radio frequency identification device after the receiving.

74. A method of forming a radio frequency identification device comprising:

providing a substrate;

supporting radio frequency identification device communication circuitry using the substrate;

providing indication circuitry configured to indicate operation of the communication circuitry;

providing a housing about at least a portion of the substrate with the indication circuitry at least partially outwardly exposed;

supporting the indication circuitry using the substrate; and coupling the indication circuitry with the communication circuitry.

75. A method of forming a radio frequency identification device comprising:

providing a substrate;

supporting radio frequency identification device communication circuitry using the substrate, the radio frequency identification device communication circuitry being configured to implement backscatter communications;

providing indication circuitry configured to indicate operation of the communication circuitry;

supporting the indication circuitry using the substrate; and coupling the indication circuitry with the communication circuitry.

76. A method of testing wireless communication operations of a wireless identification system comprising:

providing a radio frequency identification device having indication circuitry;

outputting a wireless signal;

receiving the wireless signal within the radio frequency identification device;

indicating the receiving using the indication circuitry of the radio frequency identification device; and outputting a wireless signal comprising a backscatter signal using the radio frequency identification device after the receiving.

77. A communication method comprising:

providing a wireless communication device including indication circuitry and a self-contained power source configured to supply electrical energy to the indication circuitry;

receiving a wireless signal within the wireless communication device;

indicating operation of the wireless communication device using the indication circuitry after the receiving; and outputting a backscatter signal using the wireless communication device after the receiving.

78. A method of forming a radio frequency identification device comprising:

providing a housing;

supporting communication circuitry using the housing;

providing indication circuitry configured to indicate operation of the communication circuitry externally of the housing;

supporting the indication circuitry using the housing; and coupling the indication circuitry with the communication circuitry, wherein the providing the housing comprises providing the housing about at least a portion of a substrate with the indication circuitry at least partially outwardly exposed.

79. A method of forming a radio frequency identification device comprising:

providing a housing;

supporting communication circuitry configured to implement backscatter communications using the housing;

providing indication circuitry configured to indicate operation of the communication circuitry externally of the housing;

supporting the indication circuitry using the housing; and coupling the indication circuitry with the communication circuitry.

80. A wireless communication device comprising:

a substrate;

communication circuitry coupled with the substrate and configured to at least one of receive wireless signals and communicate wireless signals;

indication circuitry coupled with the communication circuitry and the indication circuitry is configured to emit a human perceptible signal to indicate operation of the wireless communication device; and a self-contained power source coupled with the substrate and configured to supply electrical energy to the communication circuitry and the indication circuitry;

wherein the communication circuitry includes an integrated circuit defining a perimeter, and the indication circuitry is provided within the perimeter.

81. A wireless communication device comprising:

a substrate;

communication circuitry coupled with the substrate and configured to at least one of receive wireless signals and communicate wireless signals;

indication circuitry coupled with the communication circuitry and the indication circuitry is configured to emit a human perceptible signal to indicate operation of the wireless communication device; and a self-contained power source coupled with the substrate and configured to supply electrical energy to the communication circuitry and the indication circuitry;

wherein the communication circuitry comprises radio frequency identification device communication circuitry.

82. A wireless communication system comprising:

an interrogator configured to output a wireless interrogation signal; and a wireless communication device configured to communicate with the interrogator and including:

communication circuitry configured to receive the wireless interrogation signal; and indication circuitry coupled with the communication circuitry and configured to indicate operation of the device and to not output any radio frequency signals during the indication;

wherein the communication circuitry includes an integrated circuit defining a perimeter and the indication circuitry is provided within the perimeter.

83. A wireless communication system comprising:

an interrogator configured to output a wireless interrogation signal; and a wireless communication device configured to communicate with the interrogator and including:

communication circuitry configured to receive the wireless interrogation signal; and indication circuitry coupled with the communication circuitry and configured to indicate operation of the device and to not output any radio frequency signals during the indication;

wherein the wireless communication device comprises a radio frequency identification device.

84. A communication method comprising:

providing a wireless communication device including a housing about at least a portion of indication circuitry and the wireless communication device further including a self-contained power source configured to supply electrical energy to the indication circuitry;

receiving a wireless signal within the wireless communication device; and indicating operation of the wireless communication device externally of the housing using the indication circuitry after the receiving;

wherein the providing comprises providing a radio frequency identification device.

85. A communication method comprising:

providing a wireless communication system including an interrogator and a wireless communication device including communication circuitry and indication circuitry;

outputting a wireless signal using the interrogator;

receiving the wireless signal within the communication circuitry;

indicating operation of the wireless communication device using the indication circuitry after the receiving and while not outputting any radio frequency signals; and generating a response signal using the wireless communication device responsive to the receiving, and the indicating is responsive to at least one of the receiving and the generating;

wherein the providing comprises providing a radio frequency identification device.

86. A communication method comprising:

providing a wireless communication system including an interrogator and a wireless communication device including communication circuitry and indication circuitry;

outputting a wireless signal using the interrogator;

receiving the wireless signal within the communication circuitry; and indicating operation of the wireless communication device using the indication circuitry after the receiving and while not outputting any radio frequency signals;

wherein the providing comprises providing a radio frequency identification device.

87. A wireless communication device comprising:

a substrate;

communication circuitry coupled with the substrate and configured to at least one of receive wireless signals and communicate wireless signals comprising backscatter signals;

indication circuitry coupled with the communication circuitry and the indication circuitry is configured to emit a human perceptible signal to indicate operation of the wireless communication device; and a self-contained power source coupled with the substrate and configured to supply electrical energy to the communication circuitry and the indication circuitry;

wherein the communication circuitry includes an integrated circuit defining a perimeter and the indication circuitry is provided within the perimeter.

88. A wireless communication device comprising:

a substrate;

communication circuitry coupled with the substrate and configured to at least one of receive wireless signals and communicate wireless signals comprising backscatter signals;

indication circuitry coupled with the communication circuitry and the indication circuitry is configured to emit a human perceptible signal to indicate operation of the wireless communication device; and a self-contained power source coupled with the substrate and configured to supply electrical energy to the communication circuitry and the indication circuitry;

wherein the communication circuitry comprises radio frequency identification device communication circuitry.

* * * * *

Disclaimer 6,466,130—Mark T. Van Horn, Boise, ID; David K. Ovard, Meridian, ID; Scott T. Trosper, Meridian, ID (US). WIRELESS COMMUNICATION DEVICES, WIRELESS COMMUNICATION SYSTEMS, COMMUNICATION METHODS, METHODS OF FORMING RADIO REQUENCY IDENTIFICATION DEVICES, METHODS OF TESTING WIRELESS COMMUNICATION OPERATIONS, RADIO FREQUENCY IDENTIFICATION DEVICES, AND METHODS OF FORMING RADIO FREQUENCY IDENTIFICATION DEVICES. Patent dated October 15, 2002, Disclaimer filed March 13, 2003 by the attorney or agent of record, James D. Shaurette.

Hereby enters this disclaimer to claim 53 in as much as such limitations are recited in the base claim of said patent.

*(Official Gazette March 15, 2005)*

UNITED STATES PATENT AND TRADEMARK OFFICE

CERTIFICATE OF CORRECTION

PATENT NO. : 6,466,130 B2
DATED : October 15, 2002
INVENTOR(S) : Mark T. Van Horn et al.

It is certified that error appears in the above-identified patent and that said Letters Patent is hereby corrected as shown below:

Column 4,
Line 44, delete “abandoned” and insert -- U.S. Patent No. 6,289,209, -- after “now”.

Column 10,
Line 5, delete “monitoring,as n” and insert -- monitoring, as an -- after “inventory”.

Column 14,
Line 45, delete “44” after “claim” and insert -- 47 --.

Signed and Sealed this

Thirtieth Day of May, 2006

JON W. DUDAS
*Director of the United States Patent and Trademark Office*